US011864585B2

(12) United States Patent
Lin et al.

(10) Patent No.: US 11,864,585 B2
(45) Date of Patent: Jan. 9, 2024

(54) ELECTRONIC CIGARETTE EQUIPPED WITH DOUBLE AIR PRESSURE SENSORS AND CONTROL METHOD THEREOF

(71) Applicant: SHENZHEN HAPPY VAPING TECHNOLOGY LIMITED, Guangdong (CN)

(72) Inventors: Guangrong Lin, Guangdong (CN); Xianbin Zheng, Guangdong (CN); Xiyong Zhang, Guangdong (CN)

(73) Assignee: SHENZHEN HAPPY VAPING TECHNOLOGY LIMITED, Shenzhen (CN)

( * ) Notice: Subject to any disclaimer, the term of this patent is extended or adjusted under 35 U.S.C. 154(b) by 578 days.

(21) Appl. No.: 17/256,191

(22) PCT Filed: Jul. 26, 2019

(86) PCT No.: PCT/CN2019/097970
§ 371 (c)(1),
(2) Date: Dec. 25, 2020

(87) PCT Pub. No.: WO2020/038184
PCT Pub. Date: Feb. 27, 2020

(65) Prior Publication Data

US 2021/0259315 A1 Aug. 26, 2021

(30) Foreign Application Priority Data

Aug. 24, 2018 (CN) ..... 201810974221.7

(51) Int. Cl.
*A24F 40/51* (2020.01)
*A24F 40/42* (2020.01)
(Continued)

(52) U.S. Cl.
CPC ..... *A24F 40/51* (2020.01); *A24F 40/42* (2020.01); *A24F 40/10* (2020.01); *A24F 40/90* (2020.01)

(58) Field of Classification Search
CPC ..... A24F 40/51
See application file for complete search history.

(56) References Cited

U.S. PATENT DOCUMENTS 9,933,790 B2 * 4/2018 Blackley ..... G01N 33/0036
10,500,600 B2 * 12/2019 Henry, Jr. ..... A24F 40/51
(Continued)

FOREIGN PATENT DOCUMENTS

CN 207167763 U 4/2018

OTHER PUBLICATIONS

International Search Report of PCT Patent Application No. PCT/CN2019/097970 dated Oct. 12, 2019.

*Primary Examiner* — Neil Abrams

(57) ABSTRACT

The invention relates to an electronic cigarette equipped with double air pressure sensors and a control method thereof. Herein, the vaporizer of the electronic cigarette comprises a heating member, wherein a heating resistor is disposed in the heating member, and a battery, a control circuit board and an intake passage are disposed in the battery stick. The control circuit board is arranged with a micro-controlled switch, a microcontroller and a power adjustment module. Double air pressure sensors are disposed in the intake passage, including a switching air pressure sensor for detecting the suction force and determine whether the suction force reaches a switching value to switch on or off the micro-controlled switch, and a digital air pressure sensor for detecting the magnitude of the suction force during the working of the heating resistor to allow controlling of the amount of the vapor.

16 Claims, 4 Drawing Sheets

(51) Int. Cl.
*A24F 40/90* (2020.01)
*A24F 40/10* (2020.01)

(56) References Cited

U.S. PATENT DOCUMENTS

| | | | | |
|---|---|---|---|---|
| 10,503,180 | B2 * | 12/2019 | Blackley | G01N 7/04 |
| 2021/0244094 | A1 * | 8/2021 | Gallagher | A24F 40/65 |
| 2021/0259315 | A1 * | 8/2021 | Lin | A24F 40/42 |
| 2022/0287373 | A1 * | 9/2022 | Lin | A24F 40/60 |
| 2022/0322748 | A1 * | 10/2022 | Lin | A24F 40/60 |

* cited by examiner

ELECTRONIC CIGARETTE EQUIPPED WITH DOUBLE AIR PRESSURE SENSORS AND CONTROL METHOD THEREOF

TECHNICAL FIELD

The invention relates to the technical field of electronic cigarette devices, more particularly to an electronic cigarette equipped with double air pressure sensors and a control method thereof.

BACKGROUND

The electronic cigarette functions to heat the e-cigarette liquid to generate vapor during using. In this way, the user may inhale tobacco vapor that is generated. Such cigarette device generates vapor by heating the e-cigarette liquid instead of performing combustion, thereby preventing the users from being harmed by the great amount of harmful substances that may be generated during the combustion process of cigarettes. Thus, such cigarette device has been gradually and widely used.

An existing electronic cigarette comprises an intake passage, in which an air pressure sensor for detecting a pressure difference (i.e., the suction force) between the inside and the outside during using is provided. According to the suction force, the control circuit of such electronic cigarette can adjust the amount of vapor to be generated. However, a disadvantage is that, when the electronic cigarette is used by the user, it cannot determine, based on the suction force, whether or not to enter a using state or a standby state or whether or not to enter a sleep state. Hence, the electronic cigarette has high battery consumption and thus has shorter battery life and service life.

SUMMARY

Technical Problem

One goal of the invention is to provide an electronic cigarette equipped with double air pressure sensors, which not only can adjust the amount of vapor according to suction force during using, but also can automatically enter activate state or sleep state based on the suction force to save energy. Another goal of the invention is to provide a control method of an electronic cigarette equipped with double air pressure sensors.

Technical Solution

The invention provides a technical solution of an electronic cigarette equipped with double air pressure sensors, which comprises a vaporizer and a battery stick, wherein the vaporizer comprises a mouthpiece, a vaporizing tube, a liquid reservoir disposed in the vaporizing tube, a heating member and a vaporization passage, wherein a heating resistor is disposed in the heating member, and a battery, a control circuit board and an intake passage are disposed in the battery stick. It is characterized in that, the control circuit board is arranged with a micro-controlled switch, a microcontroller and a power adjustment module, the battery in turn supplies power to the power adjustment module and the heating resistor by the micro-controlled switch, and the microcontroller is provided with control circuits respectively connected with the micro-controlled switch and with the power adjustment module. Double air pressure sensors are disposed in the intake passage and are electrically connected with the microcontroller, respectively. The double air pressure sensors include a switching air pressure sensor and a digital air pressure sensor, respectively providing suction force signals for the microcontroller. The switching air pressure sensor is configured to detect the suction force and determine whether the suction force reaches a preset switching value or not. On such basis, the microcontroller may switch on or off the micro-controlled switch. The digital air pressure sensor is configured to detect the magnitude of the suction force, such that the microcontroller can adjust the power of the heating resistor according to the magnitude of the suction force, to realize controlling of the amount of the vapor. In such a case, the greater the suction force, the greater the output power, then the greater the amount of vapor to be generated. Vice versa if the smaller the suction force is.

Preferably, the switching air pressure sensor may include three pins, wherein a first pin is grounded, a third pin is connected with a positive power supply, a first filter capacitor is connected between the first pin and the third pin, a second pin is connected with the microcontroller and configured to provide switching suction force signals for the microcontroller, the second pin is further connected with a second filter capacitor, and another end of the second filter capacitor is grounded.

Preferably, the digital air pressure sensor may include eight pins, wherein a first pin and a seventh pin are grounded respectively, a third pin and a fourth pin are respectively connected with the microcontroller and configured to provide digital suction force signals for the microcontroller, a sixth pin and an eighth pin are respectively connected with a positive power supply, the sixth pin is further connected with a third filter capacitor, another end of the third filter capacitor is grounded, the eighth pin is further connected with a fourth filter capacitor, and another end of the fourth filter capacitor is grounded.

Preferably, it may further comprise a resistance value detecting module electrically connected with the heating resistor and with the microcontroller, wherein the resistance value detecting module may be configured to detect the values of the heating resistor, convert the values into corresponding electrical signals, and sent the electrical signals to the microcontroller. When an electrical signal is greater than the preset resistance value, the microcontroller disables the heating resistor via the micro-controlled switch.

Preferably, the switching air pressure sensor is disposed at a front end of the battery, and the digital air pressure sensor is disposed on the control circuit board.

Preferably, it may further comprise a battery protection module and a charging module connected with the battery and the microcontroller.

Preferably, it may further comprise a display module connected with the microcontroller.

Preferably, the microcontroller may be arranged with a parameter setting unit, and parameters preset by means of the parameter setting unit may include a preset switching value, a preset minimum value of suction force, preset values of suction force levels, and a preset maximum value of standby time.

The invention further provides a technical solution of a control method of an electronic cigarette equipped with double air pressure sensors, which comprises steps as follows.

(1) Presetting, in the microcontroller, values including: a preset switching value of suction force, a preset minimum value of suction force, preset values of suction force levels, and a preset maximum value of standby time.

(2) Detecting, by means of the switching air pressure sensor, the suction force in the intake passage during using, converting it into a switching suction force signal, and sending the switching suction force signal to the microcontroller.

(3) Determining, by means of the microcontroller, whether the switching suction force signal reaches the preset switching value or not, if yes, go to next step, if no, go back to previous one step.

(4) Switching on the micro-controlled switch to power up the power control module, to enter a working state.

(5) Detecting, by means of the digital air pressure sensor, the suction force in the intake passage during using, converting it into a digital suction force signal, and sending the digital suction force signal to the microcontroller.

(6) Determining, by means of the microcontroller, whether the digital suction force signal reaches the preset minimum value of suction force or not, if yes, go to next step, if no, go back to previous one step.

(7) Further analyzing, by means of the microcontroller, the level indicated by the digital suction force signal, based on the preset values of suction force levels.

(8) According to the level indicated by the digital suction force signal, adjusting the power control module by means of the microcontroller, to provide output power corresponding to the level to the heating resistor.

(9) Generating an amount of vapor corresponding to the level by means of the heating resistor.

(10) As the suction force disappears after one puff, stopping the output of the power control module and entering a standby state to wait for next puff.

(11) Determining, by means of the microcontroller, whether the standby time exceeds the preset maximum value of standby time or not, if yes, go to next step, if no, go back to the step (5).

(12) Switching off the micro-controlled switch to power off the power control module, entering a sleep state and going back to the step (2).

Advantages

The electronic cigarette equipped with double air pressure sensors comprises both the switching air pressure sensor and the digital air pressure sensor. Thus, it not only can adjust the amount of vapor according to suction force during using, but also can based on the suction force automatically determine whether the suction force reaches a switching value to switch on or off the micro-controlled switch. In this way, the electronic cigarette can automatically enter activate state or sleep state to save energy respectively when the user takes a puff or when the electronic cigarette is not in use for a long period, whereby battery life and service life can be increased.

DETAILED DESCRIPTION OF ILLUSTRATED EMBODIMENTS

The invention will be further explained below in detail with reference to accompanying drawings.

Figure 1:
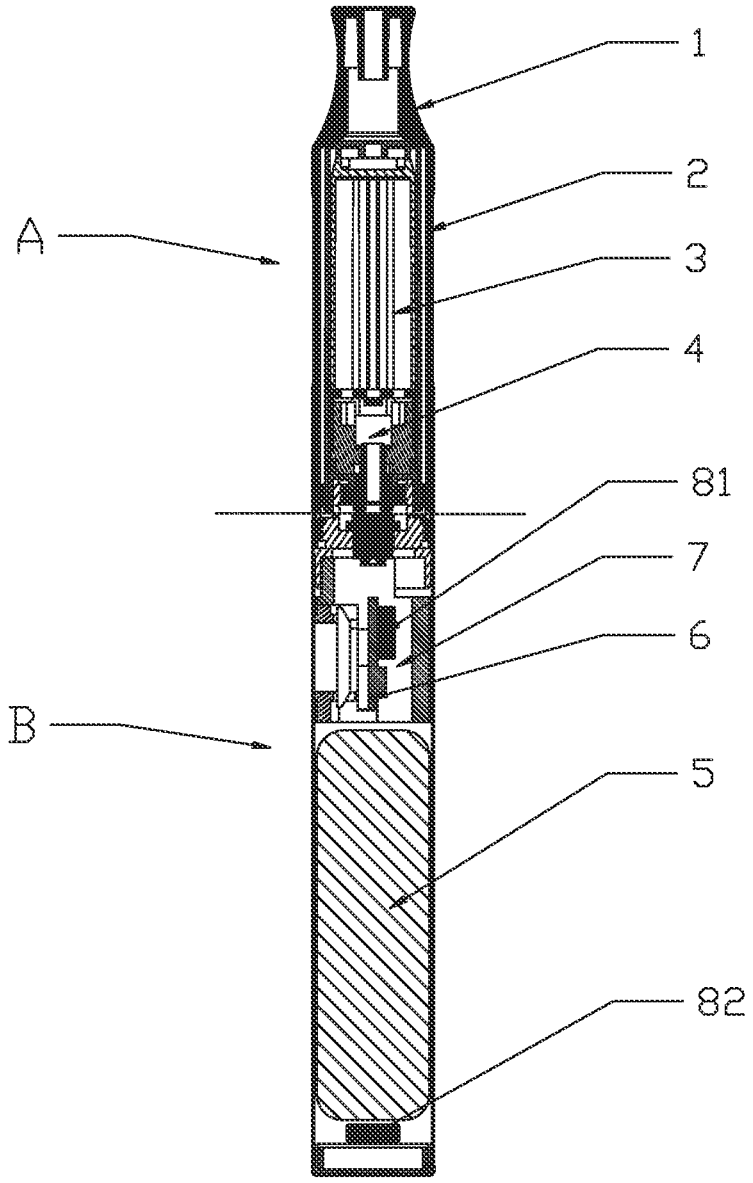
FIG. 1 is a cross-sectional view of an electronic cigarette equipped with double air pressure sensors of the invention.

Referring to FIG. 1, an electronic cigarette equipped with double air pressure sensors of the invention comprises a vaporizer A and a battery stick B. Herein, the vaporizer A comprises a mouthpiece 1, a vaporizing tube 2, a liquid reservoir 3 disposed in the vaporizing tube 2, a heating member 4 and a vaporization passage (not shown in the drawings), wherein a heating resistor (not shown in the drawings) is disposed in the heating member 4. Herein, a battery 5, a control circuit board 6 and an intake passage 7 are arranged in the battery stick B.

Figure 2:
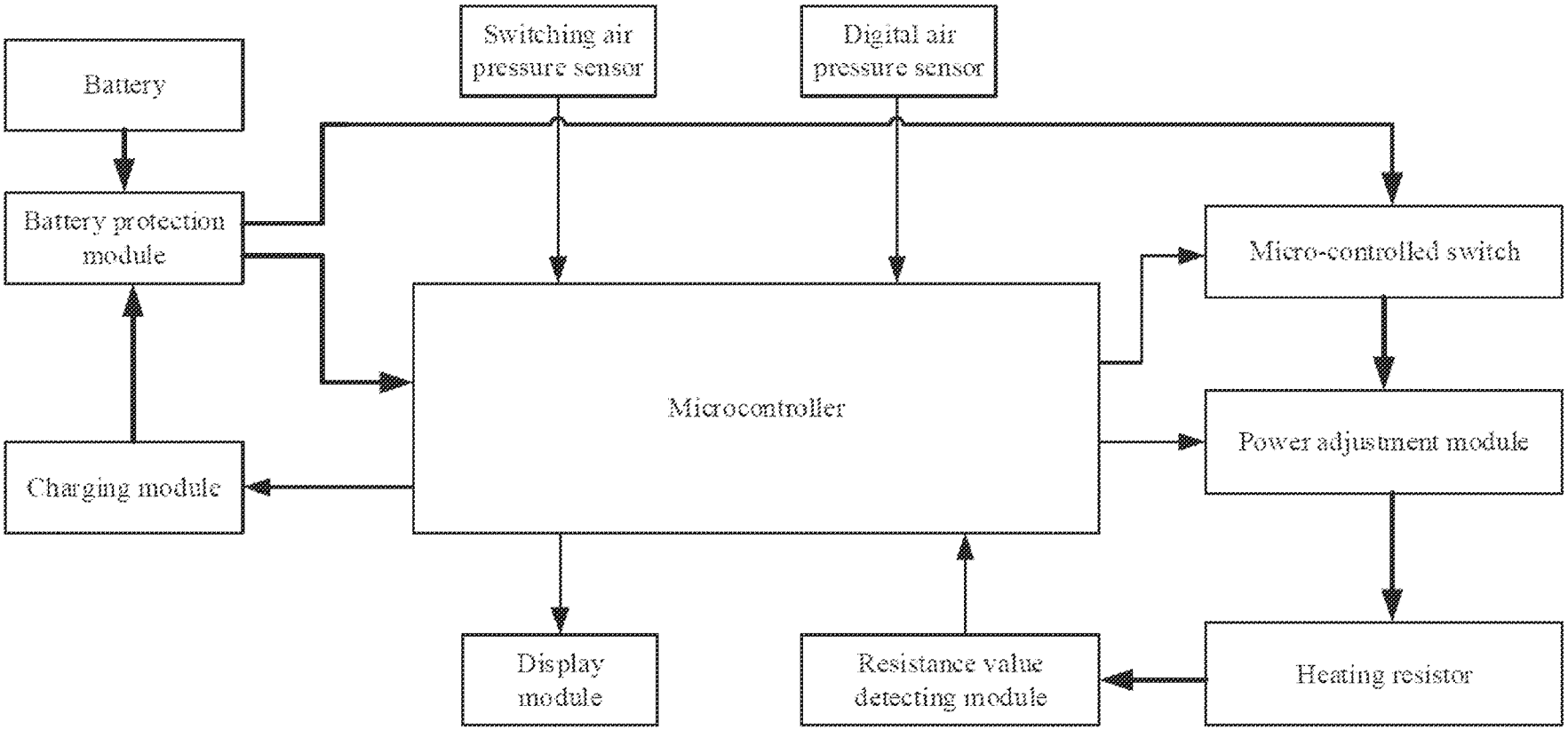
FIG. 2 is a functional block diagram illustrating a structure of a control circuit of the invention.

Referring to FIGS. 1 and 2, the control circuit board 6 is arranged with a micro-controlled switch, a microcontroller and a power adjustment module, and the battery 5 may in turn supply power to the microcontroller, the power adjustment module and the heating resistor by the micro-controlled switch. When the electronic cigarette is in a sleep state, the power supplied from the battery 5 to some functional modules of the switching air pressure sensor and the microcontroller is maintained (power supply circuits are not shown in the drawings), such that during using the user may wake up the electronic cigarette by means of the switching air pressure sensor, to continue working. The microcontroller is arranged with control circuits which are respectively connected with the micro-controlled switch and with the power adjustment module. Double air pressure sensors are disposed in the intake passage 7 and are electrically connected with the microcontroller, respectively. The double air pressure sensors include a switching air pressure sensor 82 and a digital air pressure sensor 81, respectively providing suction force signals for the microcontroller. The switching air pressure sensor 82 is configured to detect the suction force and output and send switching suction force signals to the microcontroller. The switching suction force signals may include two types of signals, i.e., high level signal and low level signal. The switching air pressure sensor 82 serves to determine whether the suction force reaches a preset switching value or not, for example, whether it is a high level signal or not, such that the microcontroller may switch on or off the micro-controlled switch. The digital air pressure sensor 81 is configured to detect the magnitude of the suction force and output and send digital suction force signals to the microcontroller. The digital suction force signals may indicate the value of the suction force. The microcontroller is configured to adjust the power of the heating resistor according to the magnitude of the suction force, so as to realize controlling of the amount of the vapor. In such a case, the greater the suction force, the greater the output power, then the greater the amount of generated vapor. Vice versa if the smaller the suction force is.

Figure 3:
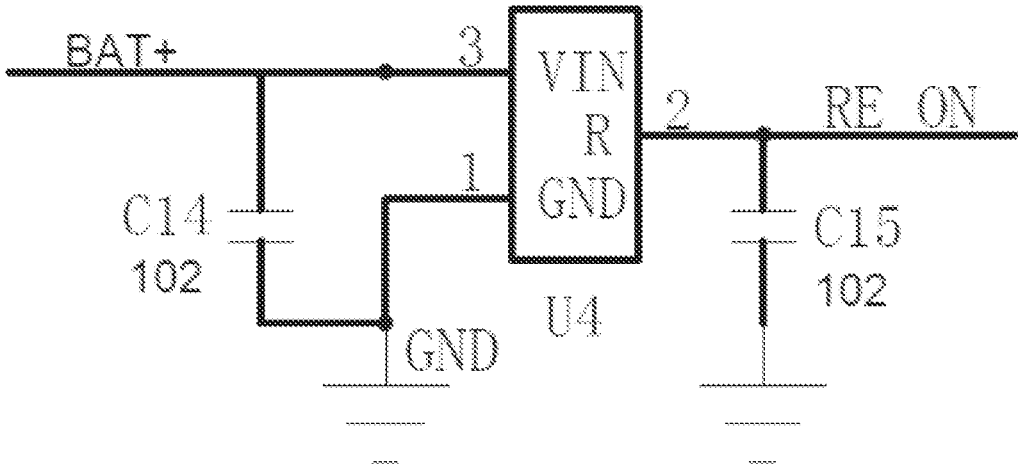
FIG. 3 is a diagram illustrating a circuit connection structure of a switching air pressure sensor of the invention.

Referring to FIG. 3, the switching air pressure sensor 82 (U4) includes three pins, wherein a first pin 1-GND is grounded; a third pin 3-VIN is connected with a positive power supply; a first filter capacitor C14 is connected between the first pin 1-GND and the third pin 3-VIN; a second pin 2-R is connected with the microcontroller and provides switching suction force signals for the microcontroller; the second pin 2-R is further connected with a second filter capacitor C15; and another end of the second filter capacitor C15 is grounded.

Figure 4:
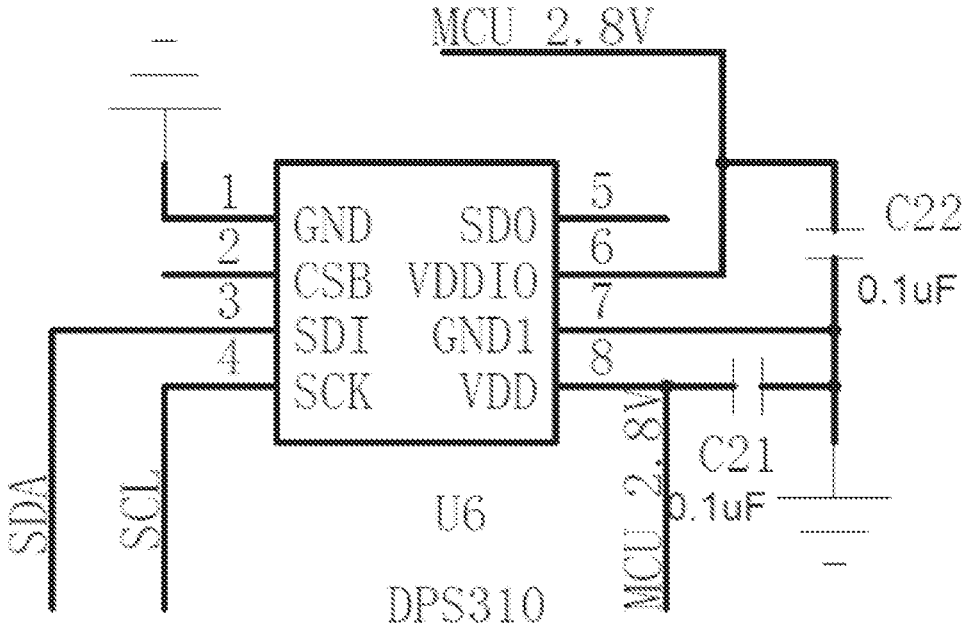
FIG. 4 is a diagram illustrating a circuit connection structure of a digital air pressure sensor of the invention.

Referring to FIG. 4, the digital air pressure sensor 81 (U6) includes eight pins, wherein a first pin 1-GND and a seventh pin 7-GND1 are grounded, respectively; a third pin 3-SDI and a fourth pin 4-SCK are respectively connected with the microcontroller and provide digital suction force signals for the microcontroller; a sixth pin 6-VDDIO and an eighth pin 8-VDD are respectively connected with a positive power supply; the sixth pin 6-VDDIO is further connected with a third filter capacitor C22; another end of the third filter capacitor C22 is grounded; the eighth pin 8-VDD is further connected with a fourth filter capacitor C21; and another end of the fourth filter capacitor C21 is grounded.

Referring to FIG. 2, the electronic cigarette equipped with double air pressure sensors of the invention further comprises a resistance value detecting module electrically connected with the heating resistor and with the microcontroller. Herein, the resistance value detecting module may be configured to detect the values of the heating resistor, convert the values into corresponding electrical signals, and sent the electrical signals to the microcontroller. When an electrical signal is greater than the preset resistance value, the microcontroller disables the heating resistor via the micro-controlled switch.

Referring to FIG. 1, in the electronic cigarette equipped with double air pressure sensors of the invention, the switching air pressure sensor is disposed at a front end of the battery, to facilitate quick detection of the suction force when a user takes a puff; and the digital air pressure sensor is disposed on the control circuit board, to facilitate quick transmission of suction force signals to the microcontroller and facilitate simple circuit arrangement.

Referring to FIG. 2, the electronic cigarette equipped with double air pressure sensors of the invention further comprises a battery protection module and a charging module connected with the battery and the microcontroller. In such a case, it can avoid battery failures or damages or the like which may be caused by excessive current, excessive temperature, excessive high charging voltage, etc., during using.

Referring to FIG. 2, the electronic cigarette equipped with double air pressure sensors of the invention further comprises a display module connected with the microcontroller. Herein, the display module may be configured to display parameters relating to the operation of the electronic cigarette, to allow the users to observe operation states of the electronic cigarette.

Referring to FIG. 2, in the electronic cigarette equipped with double air pressure sensors of the invention, the microcontroller may be arranged with a parameter setting unit (not shown in the drawings). The parameters preset by means of the parameter setting unit may include a preset switching value, a preset minimum value of suction force, preset values of suction force levels, and a preset maximum value of standby time.

Figure 5:
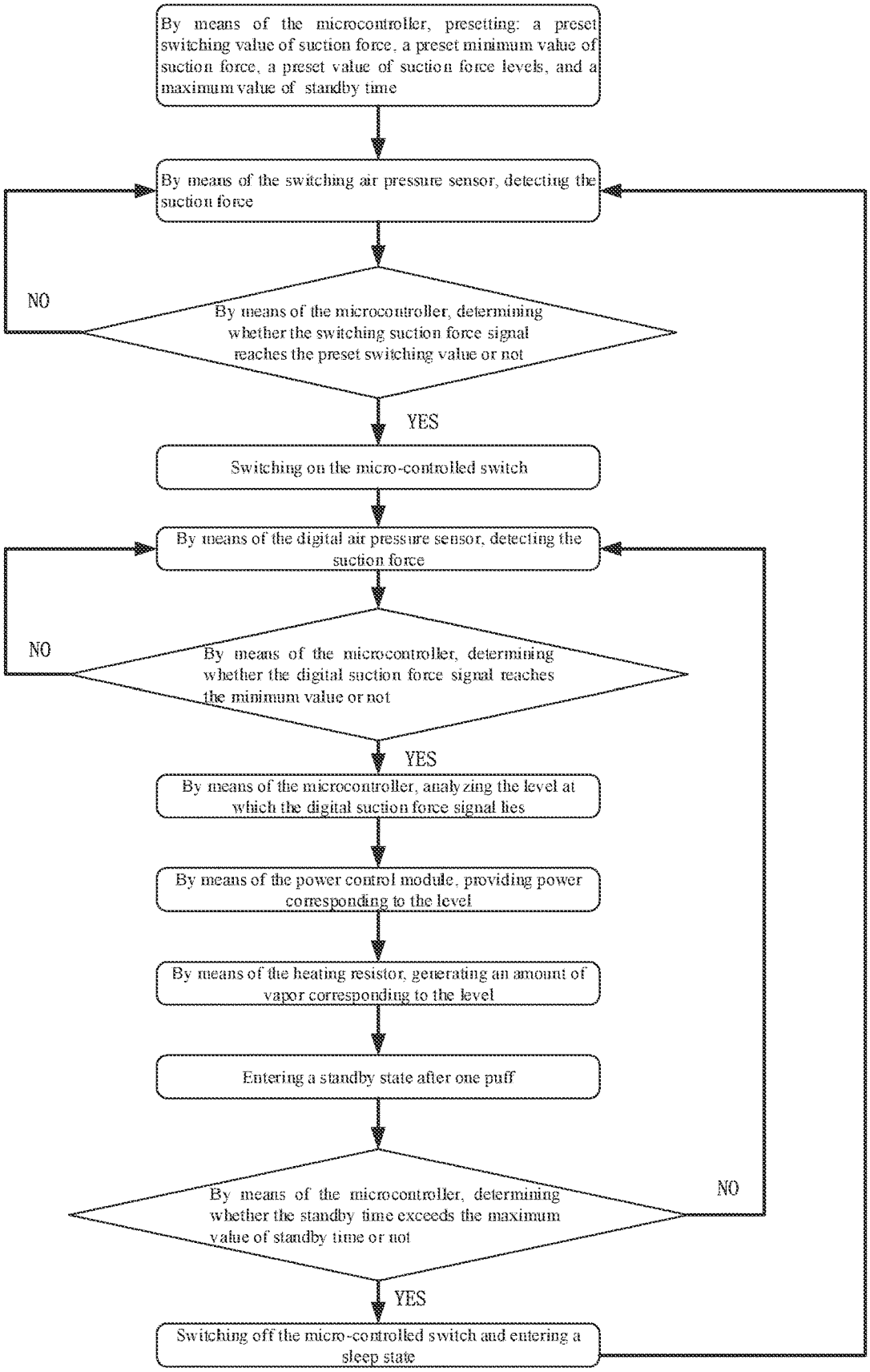
FIG. 5 is a flow diagram of a control method of an electronic cigarette equipped with double air pressure sensors of the invention.

Referring to FIG. 5, a control method of an electronic cigarette equipped with double air pressure sensors of the invention comprises steps as follows.

(1) Presetting, in the microcontroller, values including: a preset switching value of suction force, a preset minimum value of suction force, preset values of suction force levels, and a preset maximum value of standby time.

(2) Detecting, by means of the switching air pressure sensor, the suction forces in the intake passage during using, converting them into switching suction force signals, and sending the switching suction force signals to the microcontroller.

(3) Determining, by means of the microcontroller, whether the switching suction force signals reach the preset switching value or not, if yes, go to next step, if no, go back to previous one step.

(4) Switching on the micro-controlled switch to power up the power control module, and entering a working state.

(5) Detecting, by means of the digital air pressure sensor, the suction forces in the intake passage during using, converting them into digital suction force signals, and sending the digital suction force signals to the microcontroller.

(6) Determining, by means of the microcontroller, whether the digital suction force signals reach the preset minimum value of suction force or not, if yes, go to next step, if no, go back to previous one step.

(7) Further analyzing, by means of the microcontroller, the level (of the preset values of suction force levels) at which the digital suction force signals lie.

(8) According to the level indicated by the digital suction force signal, adjusting the power control module by means of the microcontroller, to provide output power corresponding to the level to the heating resistor.

(9) Generating an amount of vapor corresponding to the level by means of the heating resistor.

(10) As the suction force disappears after one puff, stopping the output of the power control module and entering a standby state to wait for next puff.

(11) Determining, by means of the microcontroller, whether the standby time exceeds the preset maximum value of standby time or not, if yes, go to next step, if no, go back to step (5).

(12) Switching off the micro-controlled switch to power off the power control module, entering a sleep state and going back to the step (2).

INDUSTRIAL APPLICABILITY

All the above are merely some preferred embodiments of the present invention, but are not to limit the invention in any form. The present invention is intended to cover all changes, various modifications and equivalent arrangements included within the spirit and scope of the present invention.

The invention claimed is:

1. An electronic cigarette equipped with double air pressure sensors, comprising a vaporizer and a battery stick, wherein the vaporizer comprises a mouthpiece, a vaporizing tube, a liquid reservoir disposed in the vaporizing tube, a heating member and a vaporization passage, wherein a heating resistor is disposed in the heating member, and a battery, a control circuit board and an intake passage are disposed in the battery stick, wherein the control circuit board is arranged with a micro-controlled switch, a microcontroller and a power adjustment module, the battery in turn supplies power to the power adjustment module and the heating resistor by the micro-controlled switch, the microcontroller is provided with control circuits respectively connected with the micro-controlled switch and with the power adjustment module, the double air pressure sensors are disposed in the intake passage and are electrically connected with the microcontroller respectively, wherein the double air pressure sensors include a switching air pressure sensor and a digital air pressure sensor respectively providing suction force signals for the microcontroller, wherein the switching air pressure sensor is configured to detect a suction force and determine whether the suction force reaches a preset switching value to enable the microcontroller to switch on or off the micro-controlled switch, the digital air pressure sensor is configured to detect a magnitude of the suction force to enable the microcontroller to adjust a power of the heating resistor according to the magnitude of the suction force, to realize controlling of vapor amount, wherein the greater the suction force is, the greater the output power is and then the greater the vapor amount is, wherein the smaller the suction force is, the smaller the output power is and then the smaller the vapor amount is.

2. The electronic cigarette equipped with double air pressure sensors according to claim 1, wherein the switching air pressure sensor includes three pins, wherein a first pin is grounded, a third pin is connected with a positive power supply, a first filter capacitor is connected between the first pin and the third pin, a second pin is connected with the microcontroller and configured to provide switching suction force signals for the microcontroller, the second pin is further connected with a second filter capacitor, and another end of the second filter capacitor is grounded.

3. The electronic cigarette equipped with double air pressure sensors according to claim 1, wherein the digital air pressure sensor includes eight pins, wherein a first pin and a seventh pin are grounded respectively, a third pin and a fourth pin are respectively connected with the microcontroller and configured to provide digital suction force signals for the microcontroller, a sixth pin and an eighth pin are respectively connected with a positive power supply, the sixth pin is further connected with a third filter capacitor, another end of the third filter capacitor is grounded, the eighth pin is further connected with a fourth filter capacitor, and another end of the fourth filter capacitor is grounded.

4. The electronic cigarette equipped with double air pressure sensors according to claim 1, wherein the electronic cigarette further comprises a resistance value detecting module electrically connected with the heating resistor and with the microcontroller, wherein the resistance value detecting module is configured to detect a value of the heating resistor, convert the value into corresponding electrical signal, and sent the electrical signal to the microcontroller, when the electrical signal is greater than a preset resistance value, the microcontroller disables the heating resistor via the micro-controlled switch.

5. The electronic cigarette equipped with double air pressure sensors according to claim 1, wherein the switching air pressure sensor is disposed at a front end of the battery, and the digital air pressure sensor is disposed on the control circuit board.

6. The electronic cigarette equipped with double air pressure sensors according to claim 1, wherein the electronic cigarette further comprises a battery protection module and a charging module connected with the battery and the microcontroller.

7. The electronic cigarette equipped with double air pressure sensors according to claim 1, wherein the electronic cigarette further comprises a display module connected with the microcontroller.

8. The electronic cigarette equipped with double air pressure sensors according to claim 1, wherein the microcontroller is arranged with a parameter setting unit, and parameters preset by means of the parameter setting unit includes a preset switching value, a preset minimum value of suction force, preset values of suction force levels, and a preset maximum value of standby time.

9. A control method of an electronic cigarette equipped with double air pressure sensors according to claim 1, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

10. A control method of an electronic cigarette equipped with double air pressure sensors according to claim 2, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

11. A control method of an electronic cigarette equipped with double air pressure sensors according to claim 3, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

12. A control method of an electronic cigarette equipped with double air pressure sensors according to claim 4, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

13. A control method of an electronic cigarette equipped with double air pressure sensors according to claim 5, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

14. A control method of an electronic cigarette equipped with double air pressure sensors according to claim 6, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

15. A control method of an electronic cigarette equipped with double air pressure sensors according to claim 7, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

16. A control method of an electronic cigarette equipped with double air pressure sensors according to claim 8, wherein the control method comprises steps of:

(1) presetting, in a microcontroller, values including: a preset switching value of suction force, a preset minimum value of suction force, preset values of suction force levels, and a preset maximum value of standby time;

(2) detecting, by means of a switching air pressure sensor, the suction force in an intake passage during using, converting the suction force into a switching suction force signal, and sending the switching suction force signal to the microcontroller;

(3) determining, by means of the microcontroller, whether the switching suction force signal reaches the preset switching value or not, if yes, go to next step, if no, go back to previous one step;

(4) switching on a micro-controlled switch to power up a power control module, to enter a working state;

(5) detecting, by means of a digital air pressure sensor, the suction force in the intake passage during using, converting the suction force into a digital suction force signal, and sending the digital suction force signal to the microcontroller;

(6) determining, by means of the microcontroller, whether the digital suction force signal reaches the preset minimum value of suction force or not, if yes, go to next step, if no, go back to previous one step;

(7) further analyzing, by means of the microcontroller, a level indicated by the digital suction force signal, based on the preset values of suction force levels;

(8) according to the level indicated by the digital suction force signal, adjusting the power control module by means of the microcontroller, to provide output power corresponding to the level to the heating resistor;

(9) generating an amount of vapor corresponding to the level by means of the heating resistor;

(10) as the suction force disappears after one puff, stopping output of the power control module and entering a standby state to wait for next puff;

(11) determining, by means of the microcontroller, whether standby time exceeds the preset maximum value of standby time or not, if yes, go to next step, if no, go back to the step (5);

(12) switching off the micro-controlled switch to power off the power control module, entering a sleep state and going back to the step (2).

* * * * *